US007253778B1

(12) United States Patent
Bingle et al.

(10) Patent No.: US 7,253,778 B1
(45) Date of Patent: Aug. 7, 2007

(54) COWL WITH EMBEDDED ANTENNA

(75) Inventors: Robert L. Bingle, Zeeland, MI (US); Joseph Meinke, Gowen, MI (US)

(73) Assignee: ADAC Plastics, Inc., Grand Rapids, MI (US)

( * ) Notice: Subject to any disclaimer, the term of this patent is extended or adjusted under 35 U.S.C. 154(b) by 49 days.

(21) Appl. No.: 11/162,352

(22) Filed: Sep. 7, 2005

Related U.S. Application Data

(60) Provisional application No. 60/522,248, filed on Sep. 7, 2004.

(51) Int. Cl.
*H01Q 1/32* (2006.01)

(52) U.S. Cl. ..... 343/713; 343/711

(58) Field of Classification Search ..... 343/704, 343/711, 712, 713
See application file for complete search history.

(56) References Cited

U.S. PATENT DOCUMENTS 3,623,108 A * 11/1971 DuBois et al. ..... 343/702
3,810,184 A * 5/1974 Boicey et al. ..... 343/713
4,760,402 A 7/1988 Mizuno et al.
5,104,711 A * 4/1992 Marsek ..... 428/78
5,918,183 A 6/1999 Janky et al.
5,977,919 A 11/1999 Kudo et al.
6,614,402 B1 9/2003 Wendt et al.
7,113,136 B2 * 9/2006 Marx ..... 343/703

* cited by examiner

*Primary Examiner*—Tho Phan
(74) *Attorney, Agent, or Firm*—McGarry Bair PC

(57) ABSTRACT

An antenna is incorporated into the cowl grille of a motor vehicle adjacent the front windshield. The antenna comprises a receiver module or component and wire or cable which extends along the cowl grille generally parallel to the front windshield. The wire or cable can extend outside the cowl grille, and terminates in a connector which can be fed to the passenger compartment of the vehicle for connection to a radio, or the wire or cable can terminate as a molded-in connector as part of the cowl plastic allowing for direct connection from the vehicles wiring harness.

12 Claims, 6 Drawing Sheets

COWL WITH EMBEDDED ANTENNA

CROSS REFERENCE TO RELATED APPLICATION

This application claims the benefit of U.S. provisional application Ser. No. 60/522,248, filed Sep. 7, 2004, which is incorporated herein in its entirety.

FIELD OF THE INVENTION

The invention relates generally to motor vehicle antennas and more particularly to an antenna incorporated into a cowl grille.

DESCRIPTION OF THE RELATED ART

Antennas for motor vehicles are ubiquitous, can take many forms, and can be used for commercial radio, television, satellite, citizens band communications, cell phone communications, and the like. Traditionally, for example, radio antennas have consisted of a flexible or telescoping rod attached to a front or rear fender. More recently, antennas have been incorporated into the front or rear windshields.

Fender-mounted antennas are susceptible to vandalism and unintended breakage, can detract from the vehicle aesthetics, can contribute to wind noise during vehicle movement, and can increase assembly time and cost at the auto assembly plant. Antennas cannot be easily incorporated into rear windows because of interference from rear window defrosters. Antennas incorporated into front windshields can interfere with visibility. Since the front windshield is most susceptible to fracture, an antenna incorporated into the front windshield is susceptible to breakage or other loss of performance due to windshield fracture. Replacement of the windshield with antennas is more costly due to the cost of the glass and the complexity of properly disconnecting and reconnecting the antenna during windshield replacement.

U.S. Pat. No. 4,760,402 to Mizuno et al. discloses an antenna concealed in a spoiler. U.S. Pat. No. 5,918,183 tojanky et al. discloses an antenna concealed in a spoiler, a CHMSL, a bumper, and a hood adjacent the windshield. U.S. Pat. No. 5,977,919 to Kudo, et al. discloses an antenna concealed in a bumper. U.S. Pat. No. 6,614,402 to Wendt et al. discloses an antenna concealed in a CHMSL. Japanese Unexamined Patent Application No. 10234672 discloses an antenna concealed in a spoiler. Each of these references disclosing an antenna concealed in a spoiler necessarily requires a spoiler, which may be aesthetically incongruent for many vehicles. As well, antennas concealed in vehicle components which are removed from the electronic device served by the antenna will necessarily require the installation of an extended connecting cable. The cable must be routed between the antenna and the electronic device, typically in an enclosed, concealed conduit, thereby complicating the installation of the antenna and adding to manufacturing costs.

SUMMARY OF THE INVENTION

In one aspect, the invention relates to a cowl for a motor vehicle comprising an elongated body adapted to be interposed in a vehicle between a windshield region of the vehicle and a front hood region of the vehicle; and an antenna mounted to the cowl in a concealed fashion, the antenna having a connector portion configured to be interconnected with a receiver associated with the vehicle.

Various embodiments of the invention are also contemplated. In one embodiment, the body can have an edge thereon adapted to be positioned adjacent to the windshield region of the vehicle, and the antenna can be located within the body generally parallel to the edge. The cowl can have a grille configured to be positioned adjacent to the windshield region of the vehicle. The antenna can have a reception portion for receiving wireless radio signals from a transmission source external to the motor vehicle. The connector portion can comprise a plug connector. The connector portion can extend away from the cowl for operable connection to the transmission source. The antenna can comprise an insulation portion. The insulation portion can be integrally formed with the cowl. The antenna can be configured to receive signals from a least one transmission source comprising an AM radio signal, an FM radio signal, a satellite radio signal, a global positioning system, a wireless network antenna, a cellular signal, and a citizens band signal. The connector portion can be molded into the cowl to engage a receiver connector when the cowl is installed onto the motor vehicle. The sensing member can comprise an insulation portion.

DESCRIPTION OF EMBODIMENTS OF THE INVENTION

Figure 1:
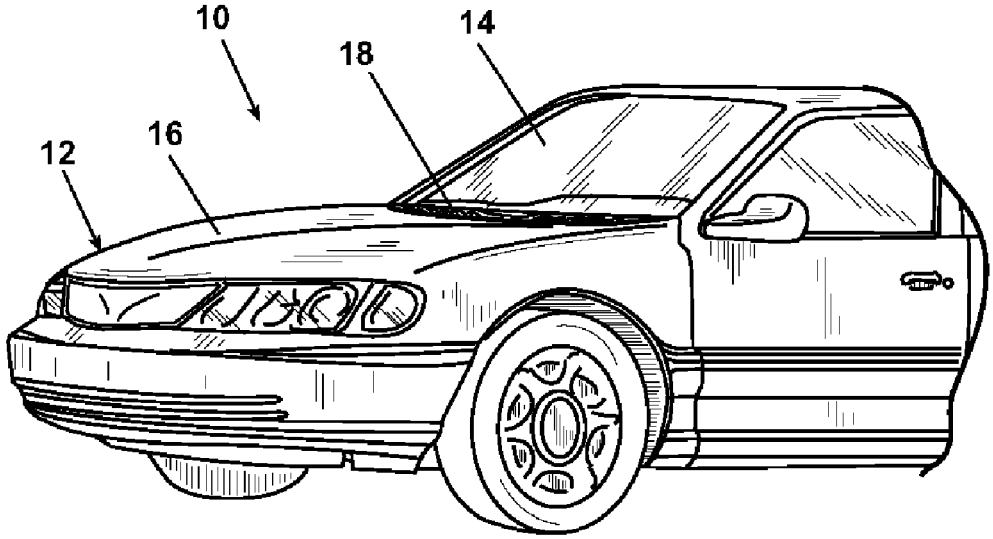
FIG. 1 is a perspective view of the front of a motor vehicle illustrating a cowl grille incorporating a motor vehicle antenna according to the invention.

Referring to the drawings, and particularly to FIG. 1, a portion of a motor vehicle 10 is shown having a generally conventional front end 12 and a windshield 14. A hood 16 extends over the front end 12 from the windshield 14 forward. A cowl 18 (also referred to as a "leaf-screen" or "cowl grille") according to the invention is interposed in a generally well-known configuration between the windshield 14 and the hood 16 to provide a grille for the introduction of fresh air into the passenger compartment and a covering for windshield wiper assemblies and other components (not shown).

Figure 2:
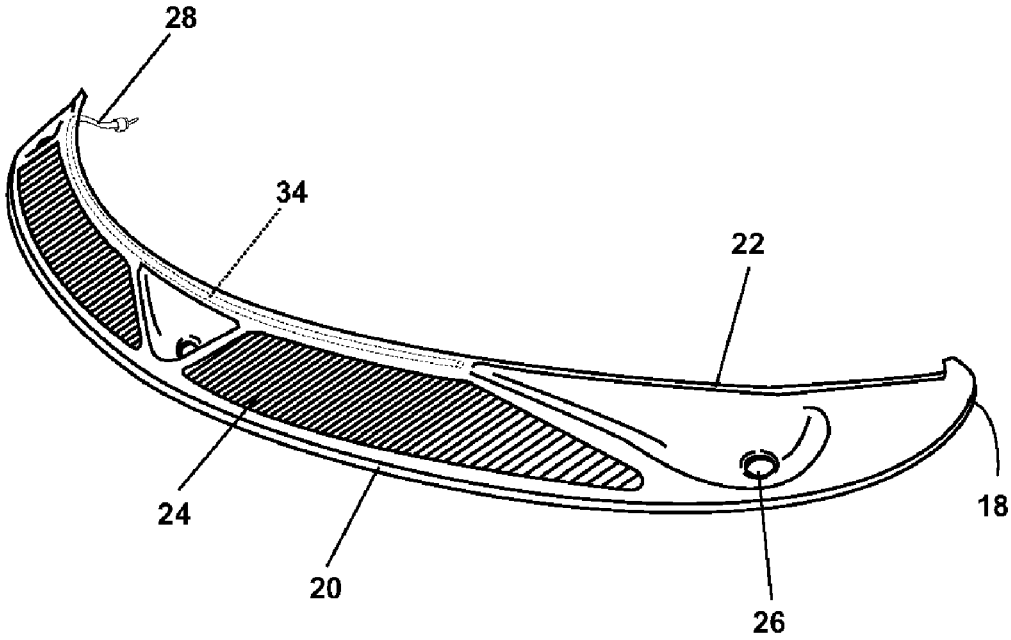
FIG. 2 is a perspective view from above of a first embodiment of the cowl grille illustrated in FIG. 1.

Referring to FIG. 2, the cowl 18 comprises a generally well-known configuration adapted for structural and aesthetic incorporation into the vehicle intermediate the windshield 14 and the hood 16. The cowl 18 extends laterally across the vehicle generally coincident with the lower portion of the windshield 14, and comprises a forward edge 20 extending toward the hood 16 and a rearward edge 22 proximal to or in contact with the windshield 14. The cowl 18 can be provided with well-known structural and aesthetic elements, such as an air grille 24 and wiper post apertures 26.

The cowl 18 is also provided with an integral antenna generally comprising a sensing member and an antenna cable. FIG. 2 illustrates a well-known AM/FM wire-type antenna comprising a sensing member 34 transitioning to an antenna cable 28. The sensing member 34 is illustrated as extending longitudinally along an underside of the cowl 18. The length of the sensing member 34 is selected in a well-known manner to provide suitable reception quality and sensitivity.

The sensing member 34 can be affixed to the cowl 18 in a suitable manner, such as by clips extending away from the underside of the cowl 18 to hold the sensing member 34 along the cowl 18, inserting the sensing member 34 into a channel provided in the cowl 18, or molding the sensing member 34 into the cowl 18 during fabrication of the cowl 18.

Figure 3:
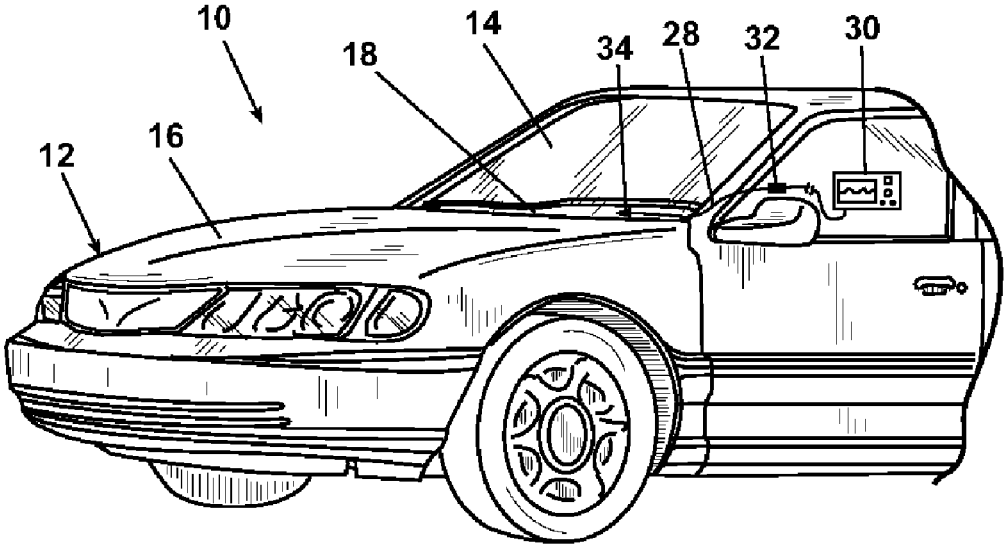
FIG. 3 is a schematic of the front of the motor vehicle and cowl grille illustrated in FIG. 1 illustrating the use of the motor vehicle antenna with a mobile electronic device.

As shown in FIG. 3, the antenna cable 28 can be extended into the passenger compartment of the vehicle for operable connection with a receiver 30 located therein through a suitable connector 32, such as a conventional plug connector with or without an interlocking component. It is anticipated that the antenna cable 28 will extend from the cowl 18 through the vehicle firewall and into the dash assembly in a generally conventional manner.

Figure 4:
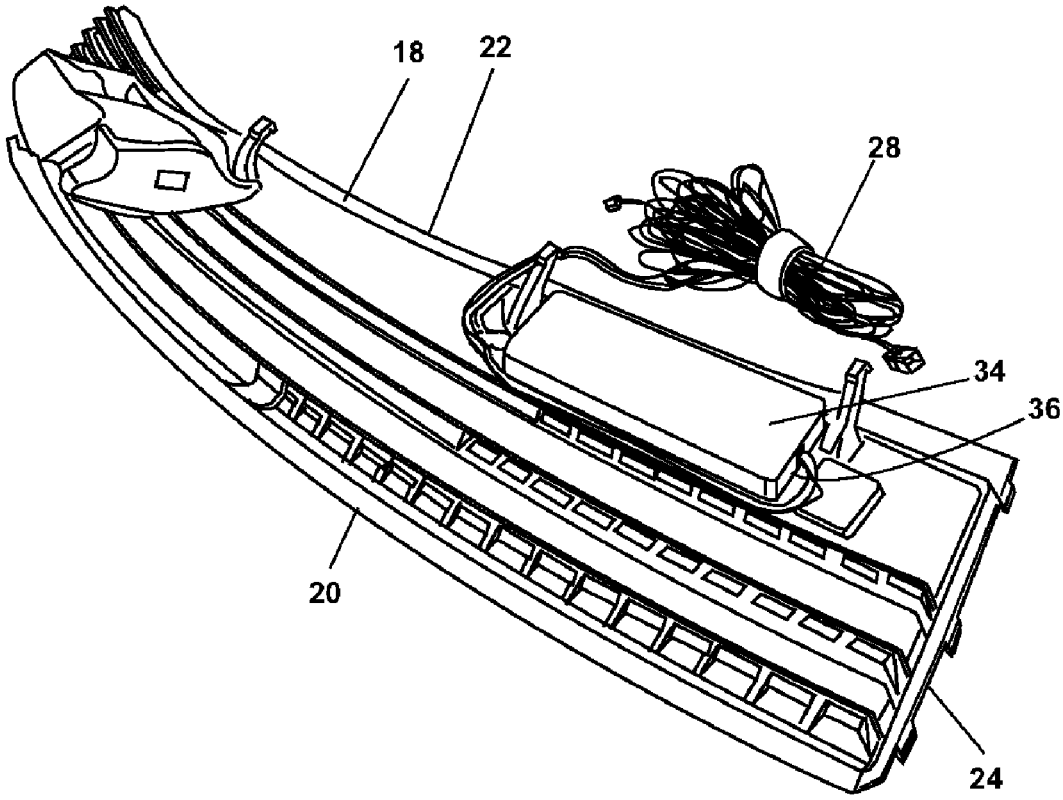
FIG. 4 is a perspective view from below of a second embodiment of the cowl grille illustrated in FIG. 1.

Referring to FIG. 4, a second embodiment of the invention is illustrated in which the sensing member 34 comprises a satellite radio sensor. The satellite radio sensor 34 is operably connected to the antenna cable 28, and comprises a suitable sensing device capable of receiving satellite radio signals. An example of such a sensing device is manufactured by Delphi Corporation for use in its Delphi XM SKYFi™ Radio system.

The sensing member 34 can be affixed to the cowl 18 in a suitable manner, such as by a mounting cradle 36 or other device appropriate to the shape and weight of the sensing member 34.

Figure 5:
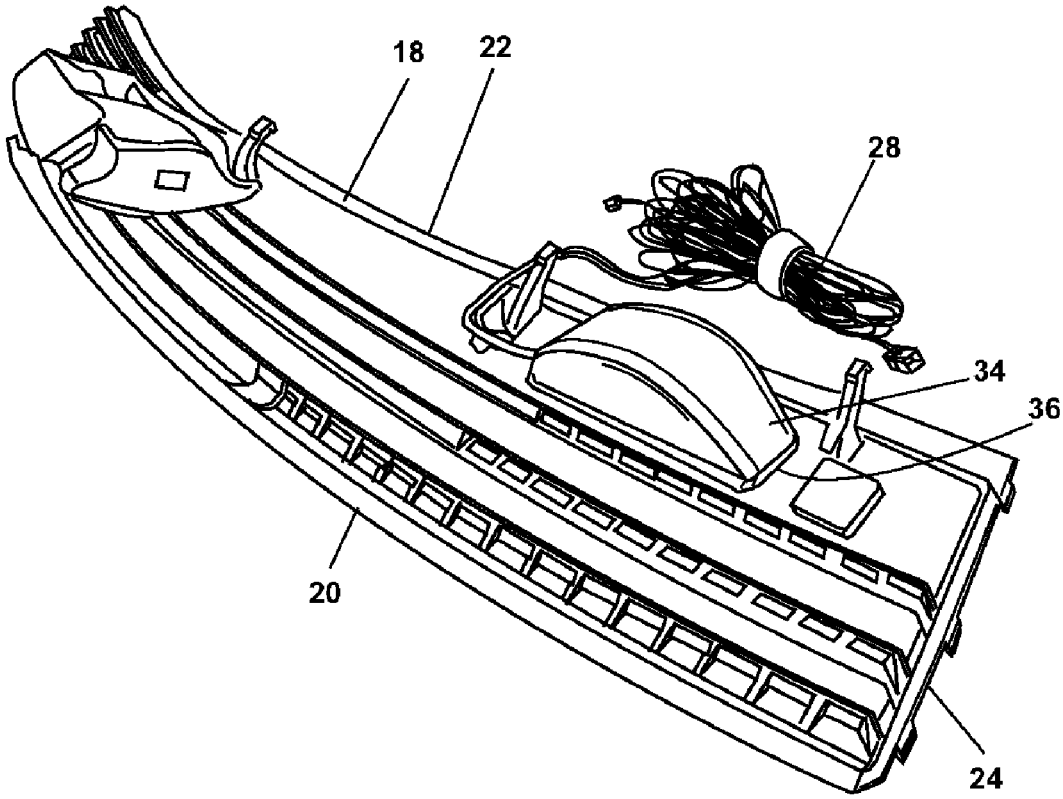
FIG. 5 is a perspective view from below of a third embodiment of the cowl grille illustrated in FIG. 1.

Referring to FIG. 5, the sensing member 34 is illustrated comprising a global positioning system (GPS) receiver, such as the GPS 35 TracPak™ manufactured by Garmin International Inc. The GPS receiver 34 is operably connected to the antenna cable 28, and can be affixed to the cowl 18 in a suitable manner, such as by a mounting cradle 36 or other device appropriate to the shape and weight of the GPS receiver 34.

The cowl 18 can be readily adapted to incorporate other antennas, such as an Internet receiver, a cell phone antenna, an OnStar™ receiver, an AM/FM satellite antenna, a passive entry antenna, a citizens band antenna, a wireless network antenna, and the like. The cowl 18 can also be adapted for mounting a preselected combination of antenna systems, such as a combined AM/FM antenna, GPS receiver, and mobile phone antenna.

Figure 6:
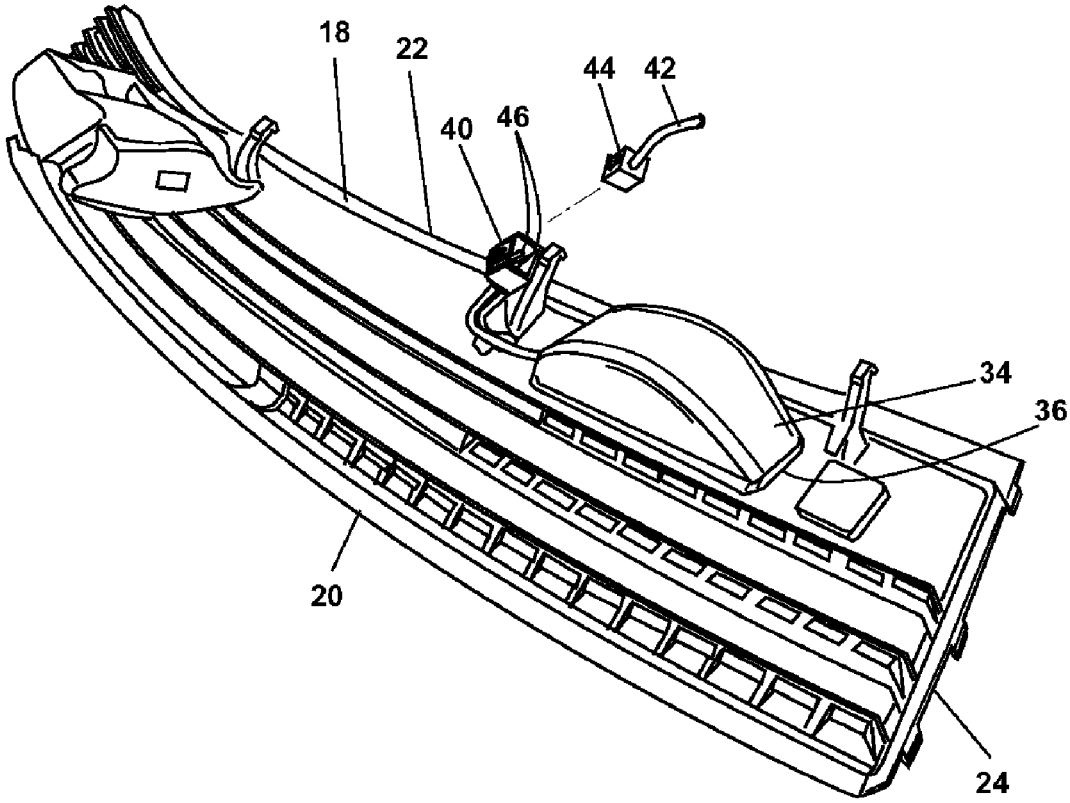
FIG. 6 is a perspective view of a molded-in connector comprising part of the cowl plastic enabling direct connection of the motor vehicle antenna with a vehicle wiring harness.

In addition to being snapped or fastened in place to the cowl 18 as a separate component, the sensing member 34 can be insert molded as part of the cowl 18. As illustrated in FIG. 6, the antenna cable 28 can be configured with a molded-in connector 40 for modular connection to a wire harness 42 having a mating connector 44. The molded-in connector 40 would comprise a pair of antenna leads 46 and could be molded as part of the cowl 18. The wire harness 42 would be connected to a radio, cell phone, GPS, or other electronic device served by the sensing member 34. Alternatively, the molded-in connector 40 could be adapted to engage a mating connector mounted to the vehicle chassis (not shown) as the cowl 18 is assembled to the vehicle 10.

The cowl 18 described herein provides enhanced cost savings over the prior art, enhanced aesthetics, and improved noise reduction characteristics. Cost reduction results from the sensing member 34 being provided as part of the cowl 18, which reduces assembly steps and assembly time in the vehicle assembly plant. The antenna cable 28 need only be plugged into a mating connector or component. The sensing member 34 reduces costs resulting from placement in alternative antenna locations, such as laminated in the windscreen (windshield) or backlight, by eliminating high costs associated with windscreen replacement, and wire routing costs associated with the backlight placement. Typical mast antennas in the rear of the vehicle also have a significant cost burden of wire material cost and wire routing, which are eliminated.

The locations of the antenna(s) in the cowl 18 will generally be ideal for minimum wire routing complexity and minimum wire material costs. In most cases, the antenna output will be input to radios and other electronic devices in the vehicle instrument panel (IP), which is typically directly behind or under the cowl 18.

Cosmetically, the antennas in the cowl 18 can be as discrete or as obvious as desired. The cowl location provides a very discrete location for antenna placement, which will also reduce wind noise and wind drag coefficients.

While the invention has been specifically described in connection with certain specific embodiments thereof, it is to be understood that this is by way of illustration and not of limitation. Reasonable variation and modification are possible within the scope of the forgoing disclosure and drawings without departing from the spirit of the invention which is defined in the appended claims.

What is claimed is:

1. A cowl for a motor vehicle comprising:

an elongated body adapted to reside between a windshield region of the vehicle and a front hood region of the vehicle, the elongated body having a concealed surface when residing between the windshield region and the front hood region;

a mounting structure incorporated into the concealed surface and adapted to attach a sensing member to the elongated body;

the sensing member attached to the concealed surface by the mounting structure; and a connector portion extending from the sensing member along the concealed surface and configured to interconnect the sensing member with a receiver associated with the vehicle.

2. The cowl of claim 1 wherein the body has an edge thereon adapted to be positioned adjacent to the windshield region of the vehicle, and the sensing member is located within the body generally parallel to the edge.

3. The cowl of claim 1 wherein the cowl has a grille configured to be positioned adjacent to the windshield region of the vehicle.

4. The cowl of claim 1 wherein the sensing member has a reception portion for receiving wireless radio signals from a transmission source external to the motor vehicle.

5. The cowl of claim 4 wherein the connector portion comprises a plug connector.

6. The cowl of claim 4 wherein the connector portion extends away from the cowl for operable connection to the transmission source.

7. The cowl of claim 4 wherein the sensing member comprises an insulation portion.

8. The cowl of claim 7 wherein the insulation portion is integrally formed with the cowl.

9. The cowl of claim 1 wherein the sensing member is configured to receive signals from a least one transmission source comprising an AM radio signal, an FM radio signal, a satellite radio signal, a global positioning system, a wireless network antenna, a cellular signal, and a citizens band signal.

10. The cowl of claim 1 wherein the connector portion is molded into the cowl to engage a receiver connector when the cowl is installed onto the motor vehicle.

11. The cowl of claim 10 wherein the sensing member comprises an insulation portion.

12. The cowl of claim 1 wherein the mounting structure comprises one of a plurality of clips, an open channel extending along the concealed surface, and a closed conduit molded around the sensing member.

* * * * *